US010190734B2

(12) United States Patent
Pearson et al.

(10) Patent No.: US 10,190,734 B2
(45) Date of Patent: Jan. 29, 2019

(54) ADJUSTABLE LENGTH ARTICULATED LED LIGHT FIXTURES

(71) Applicant: Tempo Industries, LLC, Irvine, CA (US)

(72) Inventors: Dennis Pearson, Foothill Ranch, CA (US); Wesley Scott Dochnahl, Upland, CA (US); Guang Jin, Santa Monica, CA (US)

(73) Assignee: Tempo Industries, LLC, Irvine, CA (US)

( * ) Notice: Subject to any disclaimer, the term of this patent is extended or adjusted under 35 U.S.C. 154(b) by 187 days.

(21) Appl. No.: 15/225,020

(22) Filed: Aug. 1, 2016

(65) Prior Publication Data

US 2016/0341374 A1 Nov. 24, 2016

Related U.S. Application Data

(63) Continuation of application No. 13/974,393, filed on Aug. 23, 2013, now Pat. No. 9,429,283.

(60) Provisional application No. 61/812,059, filed on Apr. 15, 2013.

(51) Int. Cl.

| | |
|---|---|
| ***F21S 2/00*** | (2016.01) |
| ***F21V 21/26*** | (2006.01) |
| ***F21V 23/06*** | (2006.01) |
| ***F21V 29/70*** | (2015.01) |
| ***F21V 29/89*** | (2015.01) |
| ***F21V 19/00*** | (2006.01) |
| ***F21V 29/50*** | (2015.01) |
| ***F21V 21/14*** | (2006.01) |
| ***F21V 21/30*** | (2006.01) |
| *F21Y 101/00* | (2016.01) |
| *F21Y 115/10* | (2016.01) |

(52) U.S. Cl.

CPC ..... *F21S 2/005* (2013.01); *F21V 19/003* (2013.01); *F21V 19/0055* (2013.01); *F21V 21/14* (2013.01); *F21V 21/26* (2013.01); *F21V 21/30* (2013.01); *F21V 23/06* (2013.01); *F21V 29/50* (2015.01); *F21V 29/70* (2015.01); *F21V 29/89* (2015.01); *F21Y 2101/00* (2013.01); *F21Y 2115/10* (2016.08)

(58) Field of Classification Search

CPC .. F21S 2/005; F21S 4/008; F21S 4/003; F21S 4/00; F21Y 2103/003

USPC ..... 362/157

See application file for complete search history.

(56) References Cited

U.S. PATENT DOCUMENTS

2012/0063138 A1* 3/2012 Leadford ..... F21S 2/005 362/249.02

* cited by examiner

*Primary Examiner* — Gerald J Sufleta, II

(74) *Attorney, Agent, or Firm* — Lapple Ubell IP Law, LLP; Franklin D. Ubell

(57) ABSTRACT

First and second modules carrying LED circuit boards are interconnected by an interconnection mechanism which enables the modules to both pivot and move linearly with respect to one another such that the distance and angle between the modules may each be varied.

15 Claims, 10 Drawing Sheets

ADJUSTABLE LENGTH ARTICULATED LED LIGHT FIXTURES

CROSS REFERENCE TO RELATED APPLICATIONS

This application is a continuation of and claims the benefit of and priority to U.S. patent application Ser. No. 13/974,393, filed Aug. 23, 2013, and to U.S. Provisional Patent Application Ser. No. 61/812,059, filed Apr. 15, 2013, both entitled, "Adjustable Length Articulated Led Light Fixtures," the contents of each of which is hereby incorporated by reference herein in its entirety.

BACKGROUND

Field of the Invention

The subject disclosure relates to lighting fixtures and more particularly to smaller scale articulated LED light fixtures installable as a series of interconnected articulated lighting units or modules and having a length adjustment feature.

Description of Related Art

Various decorative and/or accent linear lighting apparatus such as rope light, incandescent lighting, and festoon lighting have been in use for some time.

SUMMARY

The following is a summary description of an illustrative articulated modular LED lighting fixture embodiment. It is provided as a preface to assist those skilled in the art to more rapidly assimilate the detailed design discussion which ensues and is not intended in any way to limit the scope of the claims which are appended hereto in order to particularly point out the invention.

According to one embodiment, an illustrative modular light fixture apparatus may comprise a plurality of modules, each module having a base component and a cover component. In an illustrative embodiment, a first base component is provided having respectively oppositely disposed vertical side walls with a horizontal rail projecting from a respective inner surface of each side wall. A horizontally extending interconnection component is pivotally connected to a second adjacent base component and is configured to slidably mate with the respective horizontal rails of the first base component such that the interconnection component may move horizontally in and out with respect to the second base component to thereby vary the distance between the first and second base components.

A cover component carrying an LED circuit board is mountable on each base component, and has first and second depending vertical surfaces at one end thereof, which come into abutment with vertically extending tabs positioned on sidewalls of the interconnection component to thereby limit the range of relative movement between the first and second base components.

According to an illustrative embodiment, each module thus has the ability to pivot, for example, up to 90 degrees with respect to an adjacent module, and also has the ability to move linearly toward and away from an adjacent module, for example, by a distance of one-half inch so as to vary the linear space between the adjacent modules. The ability to vary the spacing between interconnected modules permits accommodating out-of-tolerance curves and bends in an array of interconnected modules and also permits adjusting the overall length of runs, while still controlling light distribution so as to avoid scalloping while still providing uniformity of illumination.

DETAILED DESCRIPTION

Figure 1:
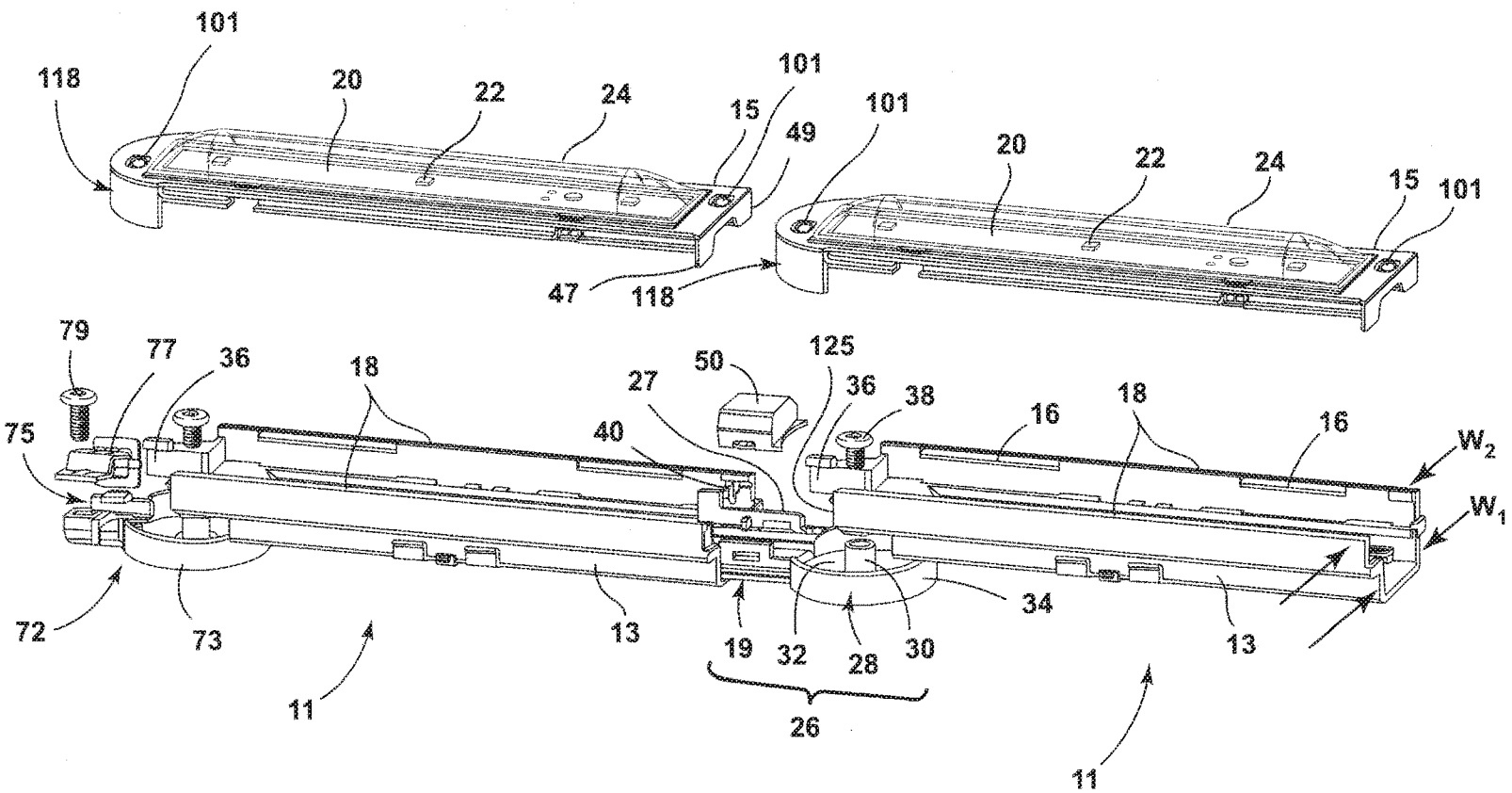
FIG. 1 is an exploded perspective view illustrating the components of first and second adjacent interconnected LED light modules according to an illustrative embodiment.
Figure 2:
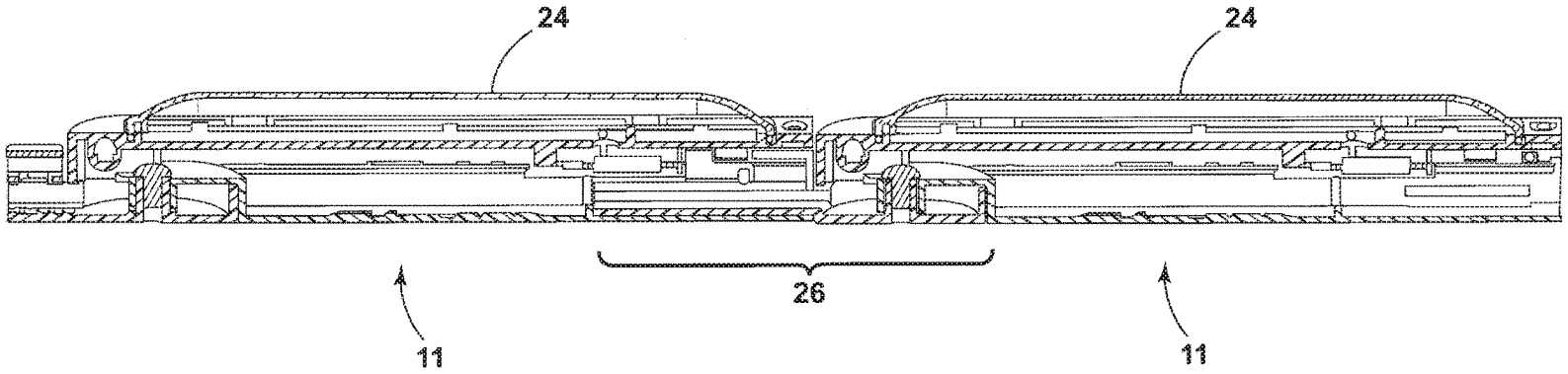
FIG. 2 is a side sectional view of first and second interconnected LED light modules.

As shown in FIGS. 1 and 2, an illustrative modular light fixture apparatus may comprise a plurality of modules 11, each module having abase component 13 and a cover component 15. In one embodiment, each base 13 and each cover 15 of each module 11 may be identically shaped and fabricated of the same material. The base 13 may be constructed, for example of a zinc alloy such as ZAMAK 3 or other suitable materials.

In an illustrative embodiment, the base 13 has a lower channel of U-shaped cross-section of a first width $W_1$, which supports an upper channel of rectangular cross-section and of a width $W_2$ greater than the first width $W_1$. The cover 15 is generally rectangular, and in one embodiment, may be dimensioned to rest on horizontal ledges, e.g. 16, formed just below the upper horizontal edges 18 of the base 13. The cover 13 further has a semi-cylindrical cap 118 of a first radius $R_1$ formed at a nose or front end thereof. The cover 13 receives and mounts a generally rectangular circuit board 20 carrying one or more LED's 22 and positioned within a lens or cover 24.

An interconnection mechanism or component 26 is positioned beneath an inner end 125 of the right-most base component 13 of FIG. 1. The interconnection component 26 includes a generally cylindrical pivoting interconnection portion or component 28 and an interconnecting tongue portion or component 19. In one illustrative embodiment, the tongue 19 and cylindrical portion 28 are formed as single unitary component, for example, formed of die-cast aluminum, a zinc alloy such as ZAMAK 3, plastic, or other material. The cylindrical portion 28 has a cylindrical male projection or boss 30 formed on its floor 32. In the illustrative embodiment, the boss 30 is concentrically positioned with respect to the outer cylindrical wall 34.

Each base 13 has an extended plug 36 formed at its inner end 125, which includes a through hole therein for receiving a screw 38. The screw 38 threads into the boss 30 of the cylindrical portion 28 of the interconnection mechanism 28 so as to pivotally mount the base 13 with respect to the interconnection component or mechanism 26. In one embodiment, the depth of insertion of the screw 38 is controlled to enable such pivotal movement. The semi-cylindrical cap 118 of the cover 15 may have the same radius $R_1$ (FIG. 4) as the outer wall 34 of the cylindrical portion 28 and may be positioned such that its contoured vertical outer surface mates flush with the vertical outer wall 34 and at the same time covers the extended plug 36, as shown, for example, in FIGS. 3 and 4, to give a clean appearance to the assembled unit or module 11.

Figure 3:
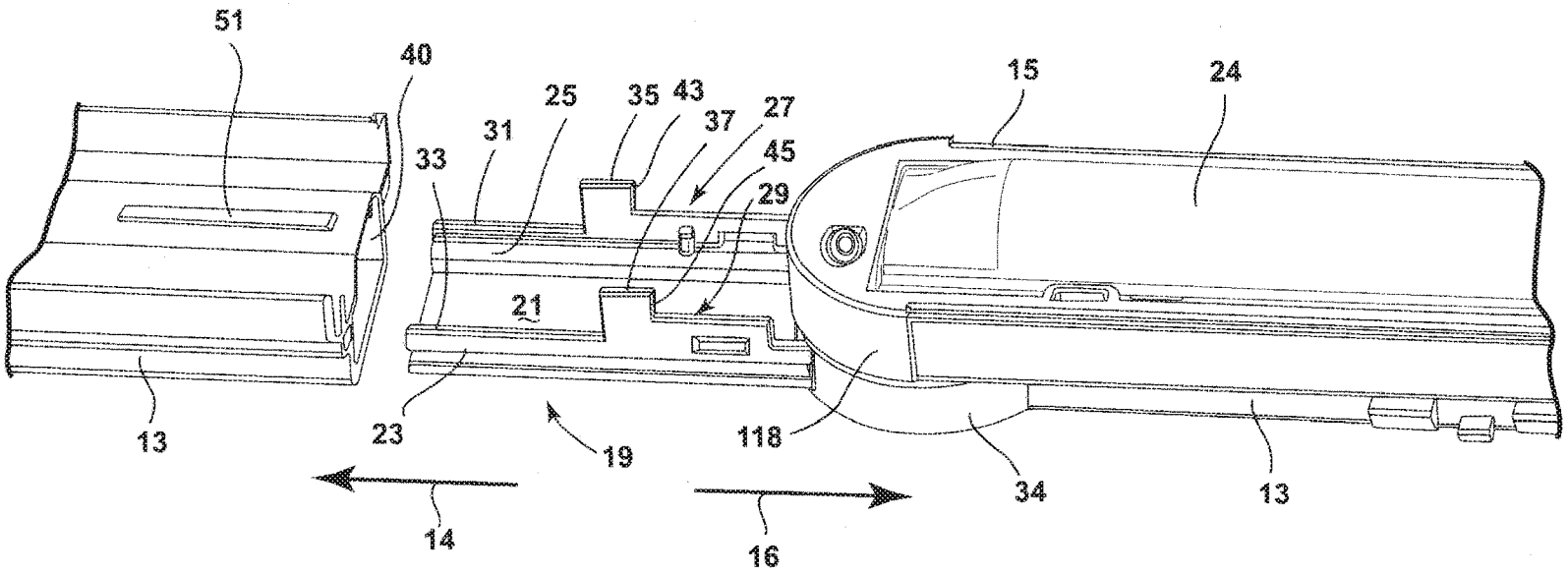
FIG. 3 is a fragmentary perspective view illustrating a module interconnection mechanism according to an illustrative embodiment.
Figure 4:
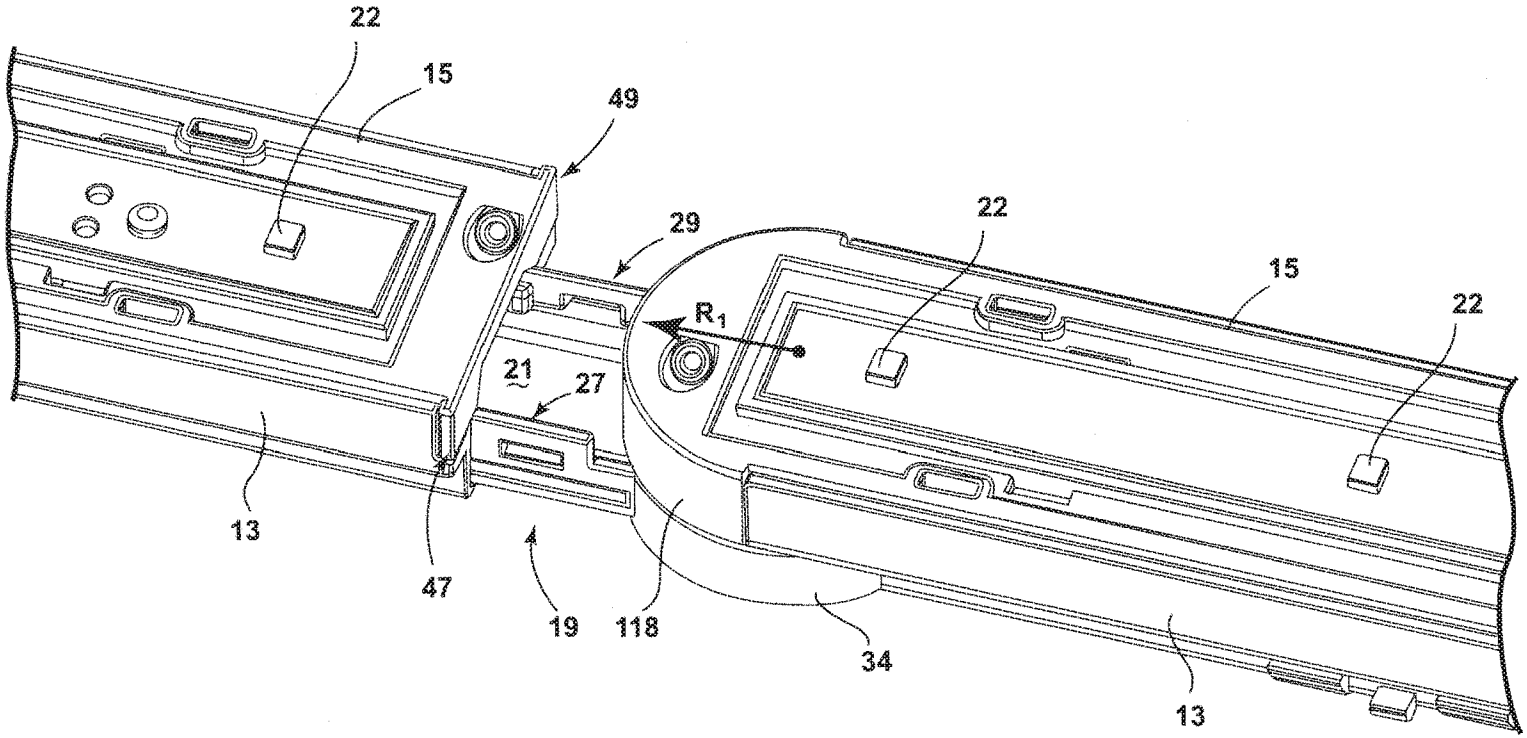
FIG. 4 is a fragmentary perspective view further illustrating the interconnection mechanism of FIG. 3.

As may be further seen in FIGS. 3 and 4, the tongue 19 has a rectangular floor 21 and respective vertical sides 23, 25. First and second vertical side rails 27, 29, are formed at an upper edge 31, 33 of each of the side rails 23, 25, and respective upwardly projecting rectangular tabs 35, 37 are formed at an end of each of the side rails 27, 29, as shown in FIG. 3.

Figure 5:
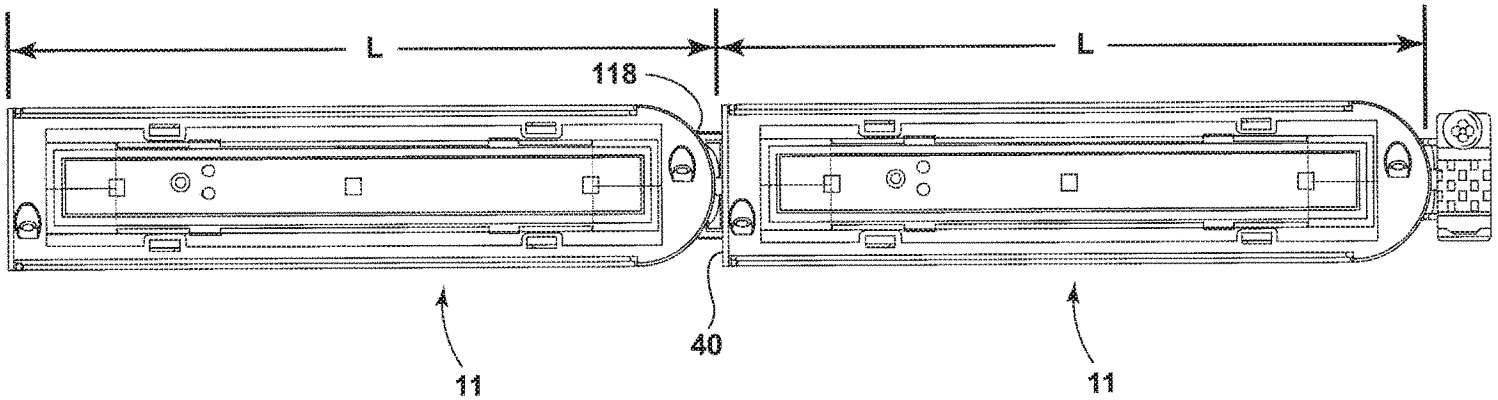
FIG. 5 is a top view of two interconnected modules according to an illustrative embodiment.

In one embodiment, as shown in FIG. 3, the inner end 40 of the adjacent left-most base component 13 and the tongue 19 are designed such that the tongue 19 slidingly mates with the end 40 of the left-most base component 13, such that the tongue 19 may move or slide horizontally into the left-most base 13 in the direction of the arrow 14 to a point where the tongue 19 is largely concealed and such that the semi-circular cap end 118 of the cover 15 lies adjacent the end 40 of the adjacent base 13, for example, as shown in FIG. 5. Similarly, the tongue 19 may slide horizontally out of the left-most base 13 in the direction of the arrow 16 of FIG. 3 to separate the units or modules 11 and extend their overall length.

Figure 6:
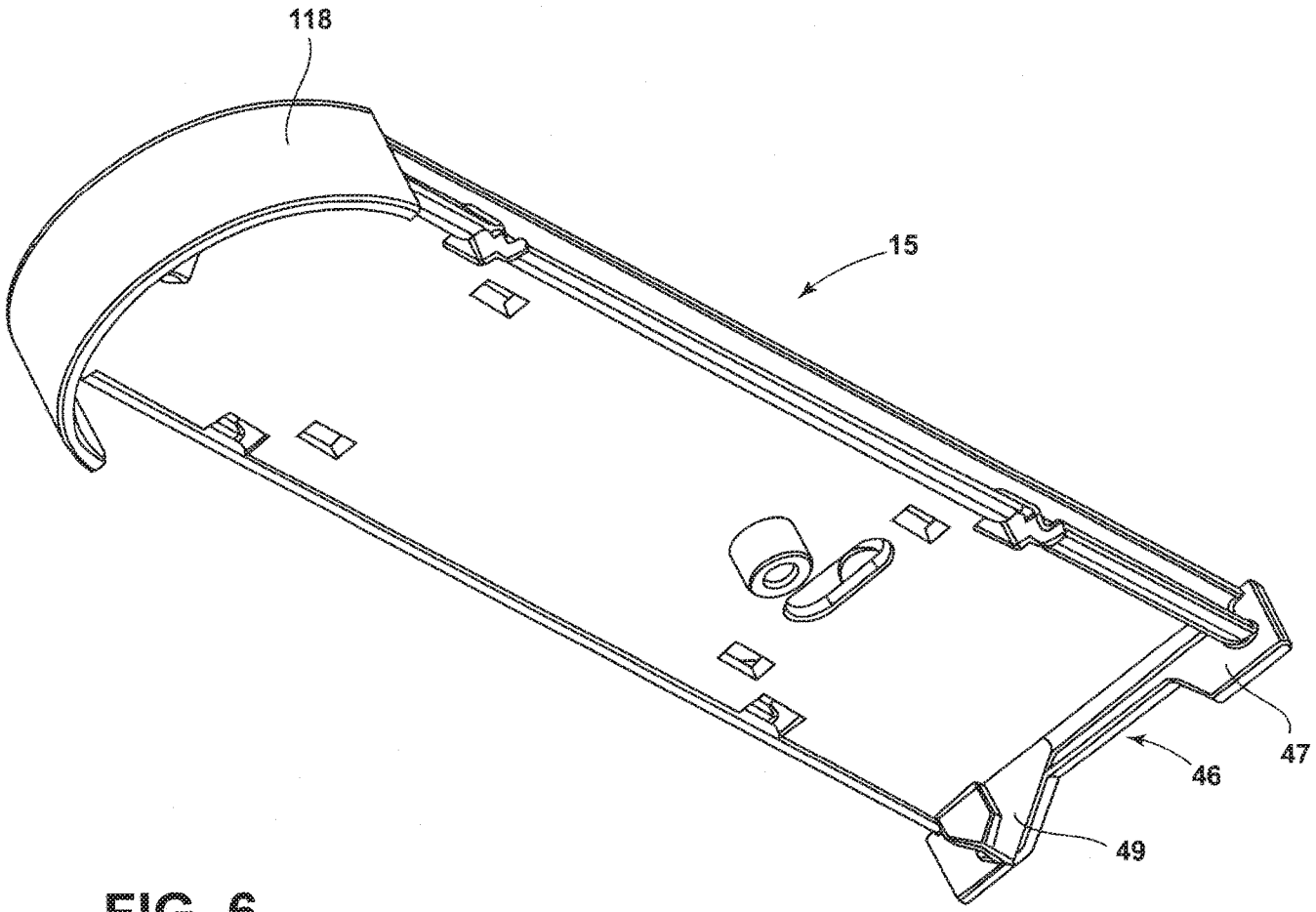
FIG. 6 is a perspective view of the underside of a cover component according to an illustrative embodiment.

The extent to which the tongue 19 can slide or move out of the base 13 in the direction of the arrow 16 is limited by the vertically extending tabs 35, 37, whose vertical front edges 43, 45 are positioned to abut respective vertical depending surfaces 47, 49 (FIG. 4, FIG. 6) formed at an inner end 46 of the cover 15. In one embodiment, the tabs 35, 37 are positioned and dimensioned such that the tongue 19 may be extended to an extent providing an additional ½ inch of overall length to that of the two modules 11. In that position, in one illustrative embodiment, a cover cap 50 (FIG. 1) may be mounted over the rails 27, 29 to conceal them, thereby providing a more aesthetically pleasing appearance. In one embodiment, when the tongue 19 slides into the adjacent base component 13, the cover cap 50 slides into the base component 13 with it, as further illustrated in FIG. 5.

Figure 8:
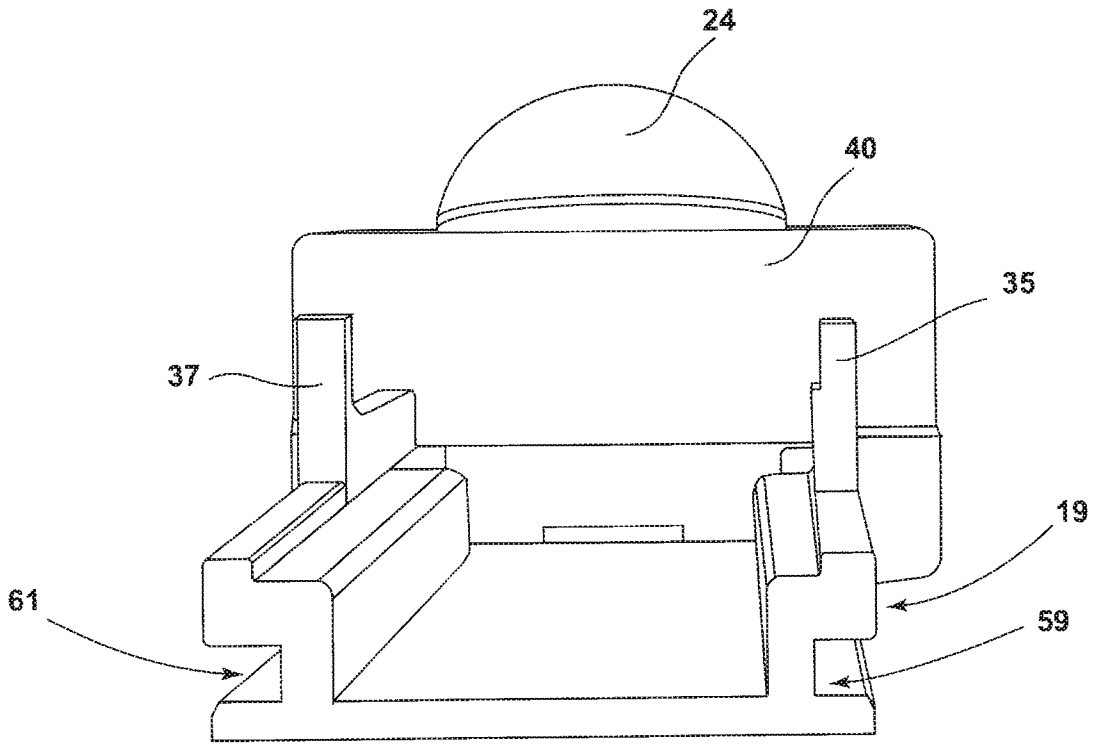
FIG. 8 is an end perspective view further illustrating a portion of the interconnection mechanism of the illustrative embodiment.
Figure 9:
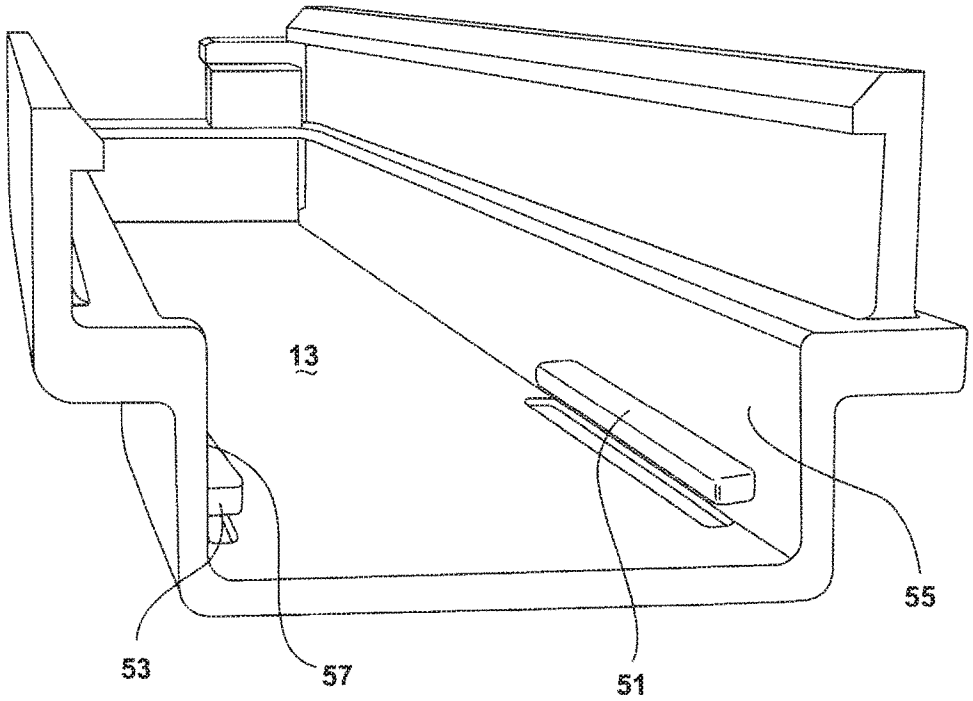
FIG. 9 is an end perspective view of a base component of a module according to an illustrative embodiment.

In an illustrative embodiment, as shown in FIGS. 8 and 9, to facilitate the in and out sliding movement of the tongue 19, respective rails 51, 53 are formed on the respective interior surfaces of the lower vertical walls 55, 57 of the base 13. Respective grooves 59, 61 are formed on opposite sides of the tongue 19 and are shaped and dimensioned to slidingly mate with or slidingly engage the rails 51, 53 such that the tongue 19 may slide into and out of the base 13. In another embodiment, grooves could be formed in the base sidewalls and rails on the tongue sidewalls to enable sliding movement. Various other constructions could be used to achieve the desired sliding extension and retraction of the tongue in various embodiments. Once extended to the desired amount, the modules 11 or mounting brackets attached to the modules 11 may be screwed or otherwise fastened into place to maintain the desired spacing.

Figure 7:
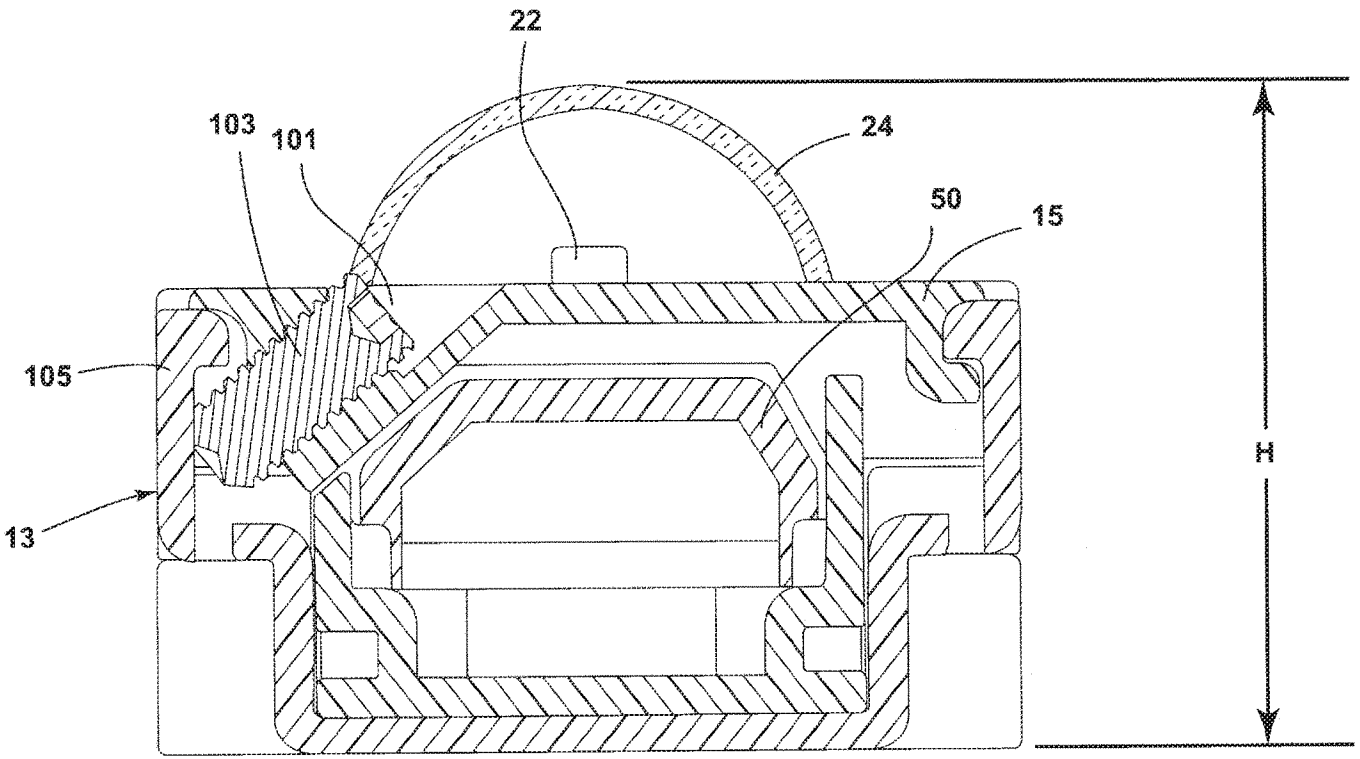
FIG. 7 is an end sectional view of an illustrative embodiment.

As shown in FIG. 1, in one embodiment each cover 15 may be provided with angled screw insertion holes 101 at opposite ends thereof. These holes 101 are positioned such that screws 103 may be inserted therein and then screwed in so as to bite into surfaces 105 of the housing or base component 13 as shown in FIG. 7 to pull the base 13 and cover 15 components tightly together so as to facilitate heat transfer and thermal management. In one embodiment, this screw insertion technique also insures proper alignment of the base 13 with respect to the cover 15 since the cover 15 will "pop out" if the screws 103 are not properly angled during insertion.

Figure 10:
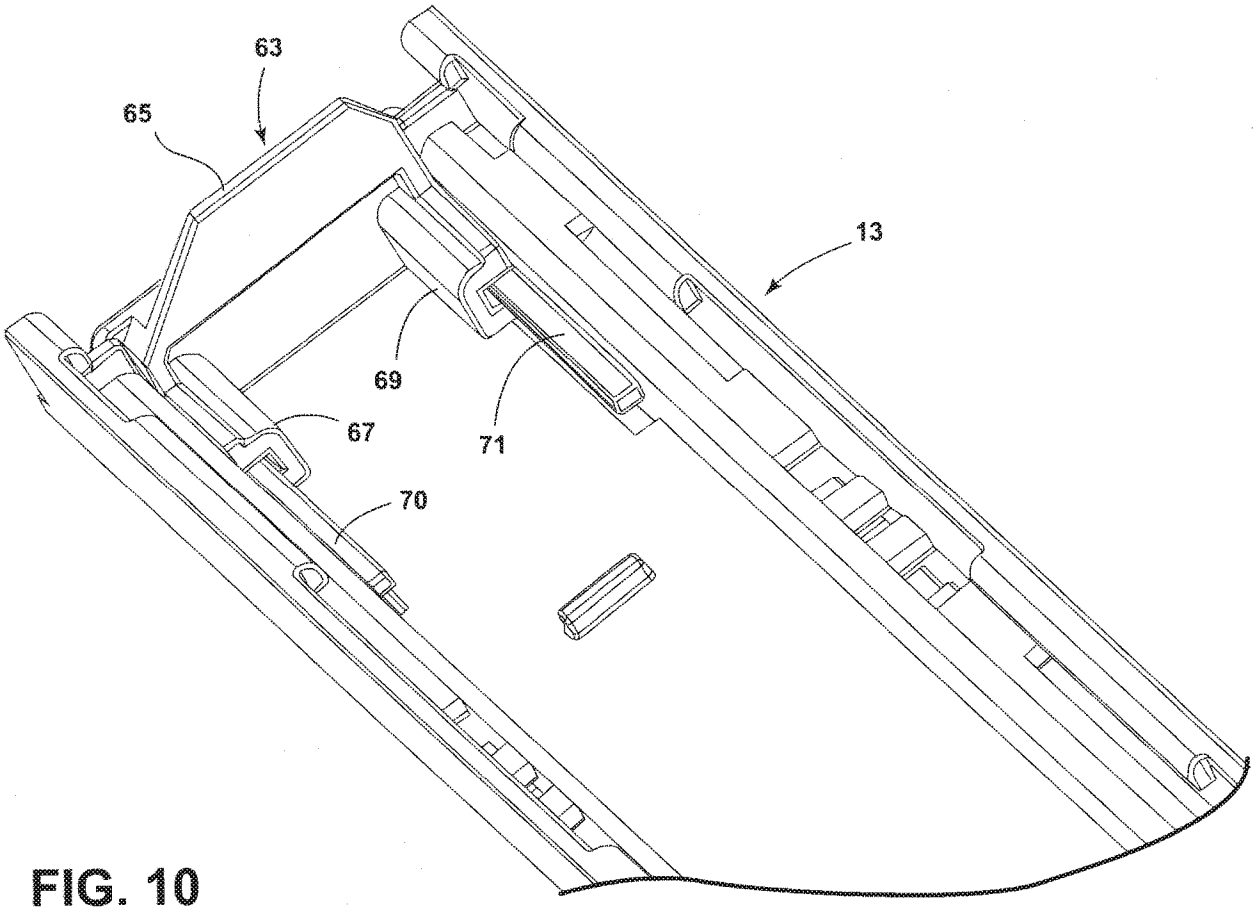
FIG. 10 is a fragmentary perspective view illustrating an end closure component according to an illustrative embodiment.

As shown in FIG. 10, an end plug 63 having a generally flat rectangular back surface 65 may be provided with side flanges 67, 69 suitably grooved to mate with respective side rails 70, 71 on the base 13, such that the plug 63 may slide in to close an open end of a base component 13 which constitutes the base component 13 of the last module 11 in an interconnected string of articulated modules 11.

At an opposite end of an interconnected string of modules 11, an end component 72 (FIG. 1) may be provided. This component 72 has a cylindrically shaped portion 73 constructed like portion 28 of the interconnection member 26, so as to flushly and conformably mate with the end cap 118 of the last or end cover component 15. In one embodiment, the end component 72 also has an extension portion, or channel 75 of u-shaped cross-section which may receive an electrical power cable held in place by an end cap 77 and screw 79. While FIG. 1 illustrates two modules 11 pivotally interconnected together, it will be appreciated that three or more modules 11 may be interconnected or strung together in the manner disclosed herein above.

In one embodiment, each module 11 may have a length (FIG. 5) of 5.98 inches, or roughly 6 inches, and a height (FIG. 7) of 1.04 inches, or roughly one inch. Such dimensions may of course be different in different embodiments.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. The LED light fixture apparatus comprising:

first and second modules, the first module comprising a first base component and a first cover component, the second module comprising a second base component and a second cover component, each of the first and second cover components carrying a circuit board mounting one or more LED's;

an interconnection mechanism pivotally connected to said first base component, the interconnection mechanism being configured such that said interconnection mechanism is slidably movable into and out of said second base component and such that said first and second base components are pivotable with respect to one another;

the first and second cover components each having first and second depending vertical surfaces at one end thereof;

wherein said interconnection mechanism has first and second vertically extending tabs respectively positioned to come into abutment with the first and second depending vertical surfaces of said second cover component to thereby limit a range of linear movement of said first base component with respect to said second base component.

2. The LED light fixture apparatus of claim 1 wherein the first and second cover components are identically shaped and wherein the first and second base components are identically shaped.

3. The LED light fixture apparatus of claim 1 wherein said interconnection mechanism comprises a cylindrical portion and a tongue portion.

4. The LED light fixture apparatus of claim 3 wherein said cylindrical portion and tongue portion are formed as a single, unitary component.

5. The LED light fixture apparatus of claim 3 wherein said tongue portion comprises:

first and second parallel vertical sides;

first and second vertical side rails formed on an upper edge of each of the first and second parallel vertical sides; and respective upwardly projecting rectangular tabs formed on each of the first and second vertical side rails.

6. An LED light fixture comprising:

a first base component having oppositely disposed vertical side walls with a horizontal rail projecting from a respective inner surface of each of said vertical side walls;

a tongue pivotally connected to a second base component adjacent said first base component, the tongue having respective grooves formed on respective outer surfaces of oppositely disposed vertical side walls thereof, said respective grooves being configured to slidably mate with said horizontal rails such that said tongue may move horizontally in and out with respect to the second base component to thereby vary a distance between the first and second base components;

a cover component mountable on said first base component, the cover component mounting an LED circuit board and having first and second depending vertical surfaces at one end thereof;

wherein said tongue has first and second vertically extending tabs respectively positioned to come into abutment with said first and second depending vertical surfaces to thereby limit movement of said tongue.

7. An LED light fixture comprising:

a first base component having oppositely disposed vertical side walls;

a tongue pivotally connected to a second base component adjacent said first base component, the tongue and first base component each having first and second sidewalls, the first and second sidewalls of the tongue being configured to slidably mate respectively with the first and second sidewalls of the first base component such that said tongue is insertable into said first base component and moveable linearly in and out with respect to the first base component to thereby vary a distance between the first and second base components; and a cover component mountable on said first base component, the cover mounting an LED circuit board.

8. The LED light fixture apparatus of claim 7 further comprising:

first and second depending vertical surfaces at one end of said cover component; and first and second vertically extending tabs on said tongue positioned to come into abutment respectively with said first and second depending vertical surfaces to thereby limit linear movement of said tongue.

9. An LED light fixture apparatus comprising:

first and second modules, the first module comprising a first base component and a first cover component, the second module comprising a second base component and a second cover component, each of the first and second cover components carrying a circuit board mounting one or more LED's;

an interconnection mechanism pivotally connected to said first base component, the interconnection mechanism being configured such that said interconnection mechanism is pivotable with respect to said first base component while at the same time the interconnection mechanism is slidably movable linearly into and out of said second base component; whereby said first and second base components are pivotable with respect to one another in a horizontal plane while at the same time being linearly movable toward and away from one another in said horizontal plane;

the first and second cover components each having first and second depending vertical surfaces at one end thereof;

wherein said interconnection mechanism has first and second vertically extending tabs respectively positioned to come into abutment with the first and second depending vertical surfaces of said second cover component to thereby limit a range of linear movement of said first base component with respect to said second base component in said horizontal plane.

10. An LED light fixture apparatus comprising:

first and second modules, the first module comprising a first base component and a first cover component, the second module comprising a second base component and a second cover component, each of the first and second cover components carrying a circuit board mounting one or more LED's;

an interconnection mechanism interconnecting said first and second base components, the interconnection mechanism comprising a tongue configured to be slidably movable linearly into and out of said second base component to thereby facilitate selecting a distance by which the first and second base components are spaced apart; and wherein said tongue is connected to the second base component, the tongue and first base component each having first and second sidewalls, the first and second sidewalls of the tongue being configured to slidably mate respectively with the first and second sidewalls of the first base component such that said tongue is insertable into the first base component and moveable linearly in and out with respect to the first base component to thereby vary a distance between the first and second base components.

11. The LED light fixture apparatus of claim 10 wherein the first and second sidewalls of said tongue and the first and second sidewalls of said first base component are each vertically disposed.

12. The LED light fixture apparatus of claim 10 wherein the first and second cover components each have respective first and second depending vertical surfaces at one end thereof; and wherein said interconnection mechanism has first and second vertically extending tabs respectively positioned to come into abutment with the first and second depending vertical surfaces of said second cover component to thereby limit a range of linear movement of said first base component with respect to said second base component.

13. An LED light fixture apparatus comprising:

first and second modules, the first module comprising a first base component and a first cover component, the second module comprising a second base component and a second cover component, each of the first and second cover components carrying a circuit board mounting one or more LED's; and an interconnection mechanism interconnecting said first and second base components, the interconnection mechanism comprising a tongue connected to the second base component, the tongue and first base component each having first and second sidewalls, the first and second sidewalls of the tongue being configured to slidably mate respectively with the first and second sidewalls of the first base component such that said tongue is insertable into the first base component and moveable linearly in and out with respect to the first base component to thereby vary a distance between the first and second base components.

14. The LED light fixture apparatus of claim 13 wherein the first and second sidewalls of said tongue and the first and second sidewalls of said second first base component are each vertically disposed.

15. The LED light fixture apparatus of claim 13 wherein the first and second cover components each have respective first and second depending vertical surfaces at one end thereof; and wherein said tongue has first and second vertically extending tabs respectively positioned to come into abutment with the first and second depending vertical surfaces of said second cover component to thereby limit a range of linear movement of said first base component with respect to said second base component.

* * * * *